US007281571B2

(12) United States Patent
Miura

(10) Patent No.: US 7,281,571 B2
(45) Date of Patent: Oct. 16, 2007

(54) RADIATOR FOR VEHICLE USE

(75) Inventor: Shinya Miura, Kariya (JP)

(73) Assignee: DENSO Corporation, Kariya (JP)

( * ) Notice: Subject to any disclaimer, the term of this patent is extended or adjusted under 35 U.S.C. 154(b) by 82 days.

(21) Appl. No.: 11/205,911

(22) Filed: Aug. 17, 2005

(65) Prior Publication Data

US 2006/0037734 A1 Feb. 23, 2006

(30) Foreign Application Priority Data

Aug. 20, 2004 (JP) ..... 2004-240991

(51) Int. Cl.
*F28F 9/007* (2006.01)

(52) U.S. Cl. ..... 165/67

(58) Field of Classification Search ..... 16/2.3, 16/2.4; 165/67; 411/82, 82.1, 103, 104, 411/171

See application file for complete search history.

(56) References Cited

U.S. PATENT DOCUMENTS 2,054,187 A * 9/1936 Almdale ..... 219/93
2,372,772 A * 4/1945 Ellis et al. ..... 411/102
2,426,653 A * 9/1947 Whelan et al. ..... 411/82.1
2,707,507 A * 5/1955 Tripp et al. ..... 411/171
2,784,758 A * 3/1957 Rohe ..... 411/171
3,435,871 A * 4/1969 Johnson ..... 411/171
4,227,570 A * 10/1980 Crews ..... 165/67

FOREIGN PATENT DOCUMENTS

| | | |
|---|---|---|
| JP | 3-146260 | 6/1991 |
| JP | 8-247689 | 9/1996 |
| JP | 2000-301323 | 10/2000 |

* cited by examiner

*Primary Examiner*—Teresa J. Walberg
(74) *Attorney, Agent, or Firm*—Harness, Dickey & Pierce, PLC

(57) ABSTRACT

A heat exchanger comprising: a plurality of tubes in which a heat exchanging medium flows; tank members to which both end portions of these tubes are connected; and a female screw portion, into which a nut for attaching another member to the tank member is incorporated, brazed to the tank member, the female screw portion including: a main body portion, at the center of which a female screw hole is formed, penetrating a wall portion of the tank member; a flange portion, which is formed on one end side in the axial direction of the main body portion, contact with an outer plane of the wall portion; and a groove portion formed on a contact face of the flange portion contact with the outer plane of the wall portion, wherein the flange portion is brazed to the wall portion.

2 Claims, 5 Drawing Sheets

RADIATOR FOR VEHICLE USE

BACKGROUND OF THE INVENTION

1. Field of the Invention

The present invention relates to a radiator, for vehicle use, used to exchange heat between the cooling water flowing in the radiator and the air flowing around the periphery of the radiator.

2. Description of the Related Art

In order to radiate heat generated from an engine mounted on a vehicle, an engine cooling system is arranged, and the main component of the engine cooling system is a radiator. In general, the radiator is composed of a flat core, in which a large number of tubes and fins are alternately arranged, and a pair of tank members provided on both sides of the core. In many cases, the core and the tank members are made of aluminum and are assembled by means of mechanical joining (screwing) or brazing.

In order to mount the related parts such as an electric fan on the radiator, it is necessary to form a mounting portion. For example, as shown in FIG. 5, in some cases, the mounting portion 75 for mounting an electric fan is formed in the upper frame 73*a* and the lower frame 73*b* of the bracket 72 surrounding the core (not shown). Concerning this structure, refer to the official gazette of JP-A-8-247689. A portion of the electric fan is attached to this mounting portion 75 by a fastening means such as a bolt and a nut.

As a comparative example, it can be considered that a nut to be used as the mounting portion is provided in each tank member. As shown in FIG. 6, the main body portion 82 of the nut 80 having the female screw hole 83 is inserted into the through-hole 87 of one wall portion 86, and the flange portion 84 is made to contact with the surface of the wall portion 86. Then, brazing is conducted using the brazing filler metal, which has been supplied between the wall portion 86 and the flange portion 84, so that the nut 80 is brazed to the tank member 85. In this case, a bolt (not shown) is screwed into the female screw hole 83 of the nut 80, and a portion of the electric fan is fixed to the tank member 35.

In the case where the nut 80 is attached onto the wall portion 86 of the tank member 85 by means of brazing in which the brazing filler metal is used, in order to prevent the deterioration of appearance caused when the brazing filler metal oozes out, in many cases, the brazing filler metal is supplied onto an inner circumferential face of the through-hole 87 of the wall portion 86 and spread outward in the radial direction. However, as the flange portion 84 is closely contacted with the wall portion 86, it is difficult for the brazing filler metal to spread out all over the contact face. Accordingly, there is a tendency for the joining strength of the nut 80 to the tank member 85 to be insufficient.

SUMMARY OF THE INVENTION

The present invention has been accomplished in view of the above circumstances. It is an object of the present invention to provide a radiator for vehicle use characterized in that: when a nut is attached to a tank member by means of brazing, in which a brazing filler metal is used, the brazing filler metal, which is supplied to a through-hole and its periphery in a wall portion, can be easily spread out all over the contact face of a flange portion of the nut so that the nut can be tightly joined to the tank member.

The present inventors found that the difficulty of spreading out the brazing filler metal is caused by the adhesion of the flange portion 84 of the nut 80 to the wall portion 86 of the tank member 85. Finally, the present inventors hit upon a novel idea of providing a groove, capable of guiding a flow of the brazing filler metal, on the contact face of the flange portion of the nut. In this way, the present invention has been completed.

A heat exchanger of a first aspect of the present invention comprises: a plurality of tubes in which a heat exchanging medium flows; tank members to which both end portions of these tubes are connected; and a female screw portion, into which a nut for attaching another member to the tank member is incorporated, brazed to the tank member.

The female screw portion includes: a main body portion, at the center of which a female screw hole is formed, penetrating a wall portion of the tank member; a flange portion, which is formed on one end side in the axial direction of the main body portion, contact with an outer plane of the wall portion; and a groove portion formed on a contact face of the flange portion contact with the outer plane of the wall portion, wherein the flange portion is brazed to the wall portion.

According to the radiator for vehicle use of the present invention, on the contact face of the flange portion of the nut used for mounting the related parts, the groove for guiding the brazing filler metal is formed. Due to the foregoing, the brazing filler metal, which has been supplied to the outer circumferential face of the main body and the inner circumferential face of the through-hole of the wall portion, is guided in the groove for guiding the brazing filler metal and flows outward in the radial direction, so that the brazing filler metal can spread all over the contact face. As a result, the nut used for mounting the related parts can be tightly brazed to the tank member.

According to the radiator of a second aspect of the present invention, as a plurality of grooves for guiding the brazing filler metal are radially formed, the brazing filler metal can be more positively spread all over the contact face of the flange portion.

(a) The Whole

The radiator for vehicle use of the present invention may be applied to a four-wheel vehicle (passenger car) or a motor-bicycle. The radiator for vehicle use includes: at least a core; and a pair of tank members provided on both sides of the core, wherein a nut used for mounting the related part on each tank member is brazed. This nut used for mounting the related part on the tank member is referred to as a "nut" in the column of the most preferred embodiment of the present invention in this specification. In this case, an example of "the related part" is an electric fan. Another example of "the related part" is a reserve tank or a cover made of resin or iron.

(b) Core

The core has a function of decreasing the temperature of cooling water by exchanging heat between the cooling water flowing in the core and the air flowing around the periphery of the core. The core is composed in such a manner that a large number of tubes made of aluminum are arranged at predetermined intervals and fins are arranged between the tubes adjacent to each other. On one end opening side of the tubes, one tank member is arranged, and on the other end opening side, the other tank member is arranged.

The core is formed into a flat shape, the thickness of which is small compared with the sizes in the longitudinal and the lateral direction, that is, the entire core is formed into a rectangular parallelepiped. In this connection, the core may be formed into a shape which is bent in the intermediate portion in the longitudinal direction or in the lateral direction. The core may be used by being arranged as a lateral type in which the tubes are extending in the lateral direction. Alternatively, the core may be used by being arranged as a longitudinal type in which the tubes are extending in the longitudinal direction.

(c) Tank Member

The pair of tank members are made of aluminum. The cooling water, the temperature of which has been raised in an engine, is made to flow into the core from the tank member, and the cooling water, the temperature of which has been lowered in the core, is returned from the core to the engine by the tank member. One tank member is attached to one end portion of the core, and the other tank member is attached to the other end portion of the core. Both the water supply portion and the water drainage portion of the cooling water may be formed in one tank member or the other tank member. Alternatively, one of the water supply portion and the water drainage portion of the cooling water may be formed in one tank member, and the other may be formed in the other tank member. In the case where the core is used by being arranged as the longitudinal type, one tank member is located in an upper portion, and the other tank member is located in a lower portion. In the case where the core is used by being arranged as the lateral type, one tank member is located on the left, and the other tank member is located on the right.

One nut or two or more nuts are brazed to one tank member and/or the other tank member. A nut may be brazed to only one tank member. Alternatively, a nut can be brazed to only the other tank member. Alternatively, nuts can be brazed to both tank members. The sizes of the two or more nuts may be the same or different from each other. The nut includes: a columnar main body portion; and an annular flange portion formed in one end of the main body portion in the axial direction. The outer diameter of the flange portion is larger than the outer diameter of the main body portion.

On the contact face on which the flange portion is contacted with one wall portion of the tank member, a groove for guiding the brazing filler metal, which extends from the inner circumferential portion of the flange portion to the outer circumferential edge in the radial direction, is formed. At least one groove for guiding the brazing filler metal may be formed, however, it is preferable that a plurality of grooves for guiding the brazing filler metal are formed in the radial direction. The number and the shape (width and depth) may be determined by giving consideration to the size of the flange portion. In this connection, the nut is manufactured by means of cold forging, and it is preferable that the guide grooves for guiding the brazing filler metal are simultaneously formed at the time of cold forging. However, the guide grooves for guiding the brazing filler metal may be formed by another manufacturing process.

(d) Other Members

One core plate can be arranged between one end portion of the core and one tank member, and the other core plate can be arranged between the other end portion of the core and the other tank member. One mounting bracket can be arranged in one side portion of the core, and the other mounting bracket can be arranged in the other side portion of the core. One mounting bracket and the other mounting bracket are provided with a mounting portion for fixing the related parts to the radiator in collaboration with the nut described before.

The present invention may be more fully understood from the description of preferred embodiments of the invention set forth below, together with the accompanying drawings.

DESCRIPTION OF THE PREFERRED EMBODIMENTS

Referring to the accompanying drawings, an embodiment of the present invention will be explained below.

Figure 1:
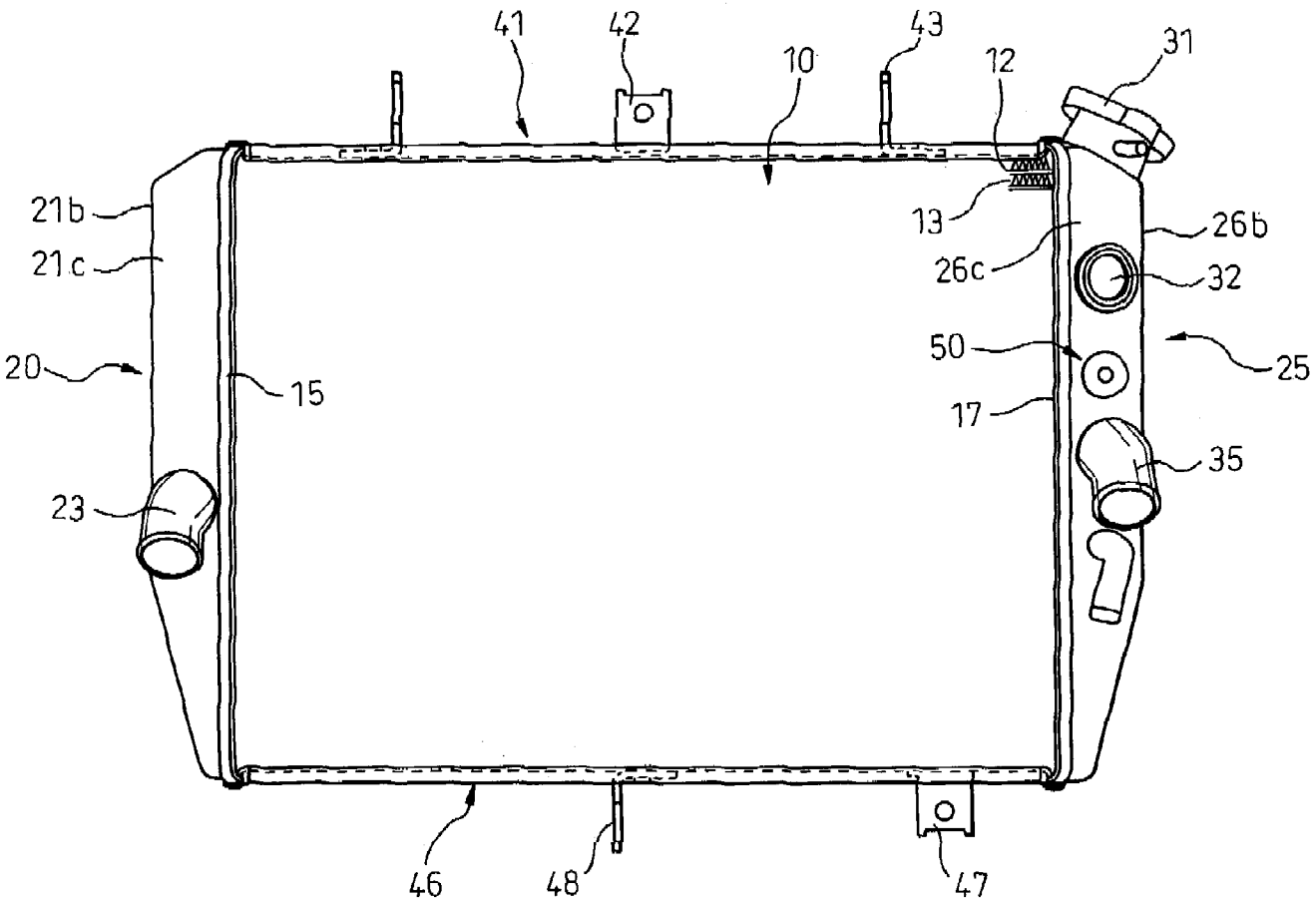
FIG. 1 is a front view showing a radiator for vehicle use of an embodiment of the present invention.
Figure 2:
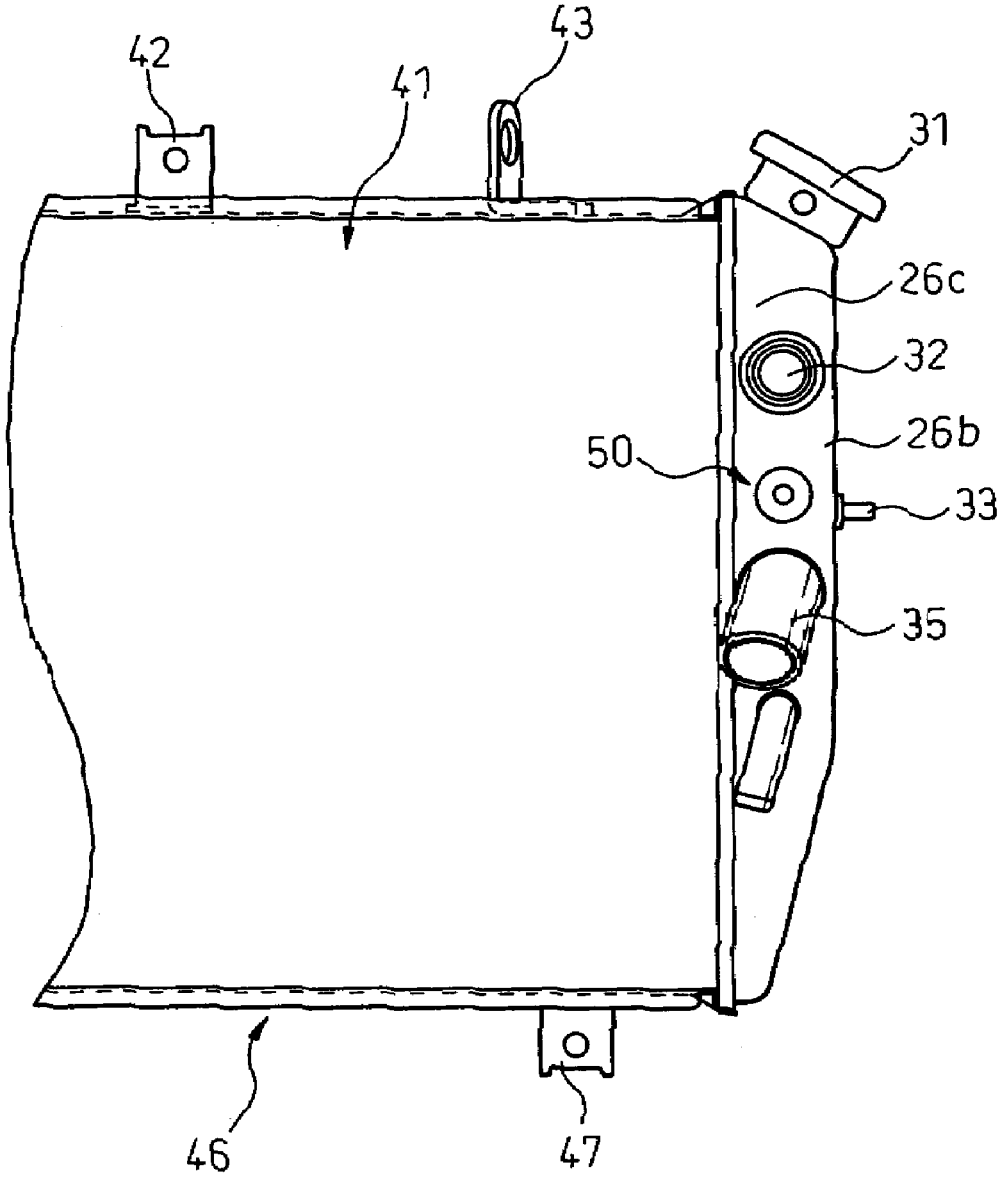
FIG. 2 is a perspective view showing a primary portion of FIG. 1.
Figure 3:
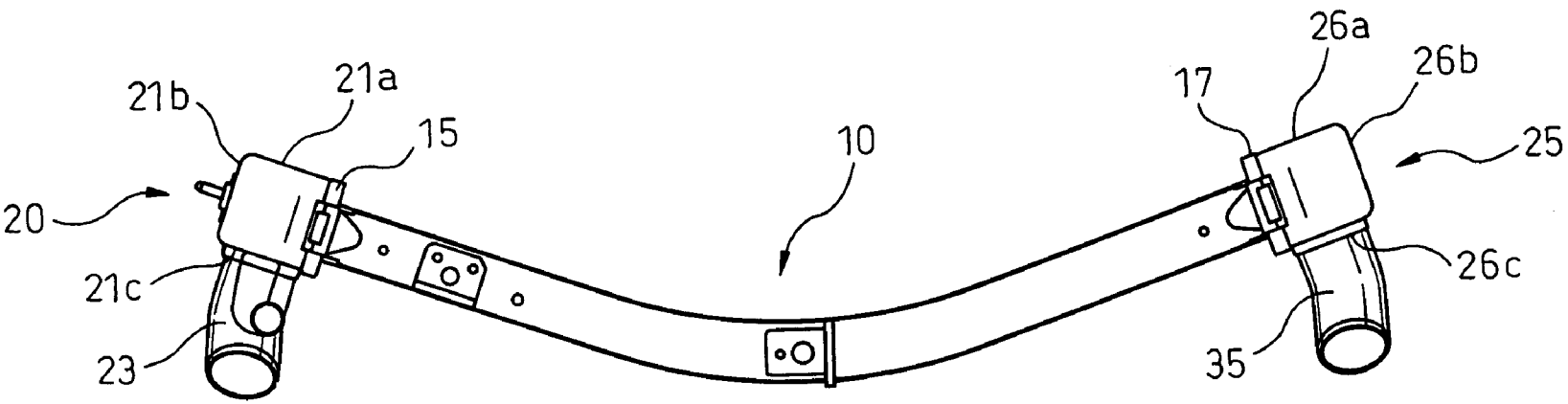
FIG. 3 is a lower face view showing a radiator for vehicle use of an embodiment of the present invention.

First of all, the constitution of the embodiment will be explained as follows. The radiator used for a motor-bicycle shown in FIGS. 1, 2 and 3 is a heat exchanger in which heat is exchanged between the cooling water, the temperature of which is high because the cooling water is circulated in a water jacket of an engine, and the air. The radiator used for a motor-bicycle includes: a core 10; a pair of core plates 15, 17; a pair of tank members 20, 25; and a pair of mounting brackets 41, 46. In this structure, the core 10 is composed in such a manner that a large number of tubes 12, which extend to the right and left (the lateral direction), are laminated in the vertical direction (the longitudinal direction). Between the tubes 12 which are adjacent to each other, the wave-shaped fins 13 are arranged. The shape of the core 10 is formed into a flat rectangular parallelepiped. The intermediate portion in the width direction (the horizontal direction in FIGS. 1 and 3) of the core 10 is bent.

The left core plate 15, which is attached to the left end portion of the core 10, and the right core plate 17, which is attached to the right end portion of the core 10, are respectively provided with a large number of through-holes (not shown) corresponding to the openings formed at both end portions of the tubes 12. The left tank member 20 is composed of three wall portions 21*a*, 21*b*, 21*c* and incorporated into the left core plate 15. In the wall portion 21*c*, the pipe portion (the drainage portion) for returning the cooling water to the engine is formed.

The right tank member 25 is composed of three wall portions 26*a*, 26*b*, 26*c* and incorporated into the right core plate 17. The filler hole 31 of filling the cooling water is formed in the right shoulder portion of the right tank 25. The sensor inserting portion 32 for inserting a water temperature sensor is formed in a portion close to the upper end portion of the wall portion 26*c*. In the intermediate portion of the wall portion 26*b*, the mounting portion 33 for mounting a reserve tank is formed. The nut 50 for attaching an electric fan is brazed to the wall portion 26*c* (The detail will be described later.), and the pipe portion 35 (the water supply portion) for receiving the cooling water from the engine is formed. The left tank member 20 and the right tank member 25 are made of aluminum. The outer wall planes of the tank members are not clad with the brazing filler metal, and only the inner wall planes are clad with the brazing filler metal.

At the upper end portion and the lower end portion of the core 10, the upper mounting bracket 41 and the lower mounting bracket 46 are respectively provided. In the upper mounting bracket 41, the mounting portion 42 for mounting an electric fan (not shown) and the mounting portion 43 for mounting a radiator on a vehicle are formed. In the lower mounting bracket 46, the mounting portion 47 for mounting the electric fan (not shown) and the mounting portion 48 for mounting the radiator on the vehicle are formed. The electric fan is mounted on the mounting portions 42, 47 by a fastening means such as a bolt and a nut. Further, when a bolt (not shown) is screwed to the nut, the electric fan is fixed to the right tank 25.

Figure 4A:
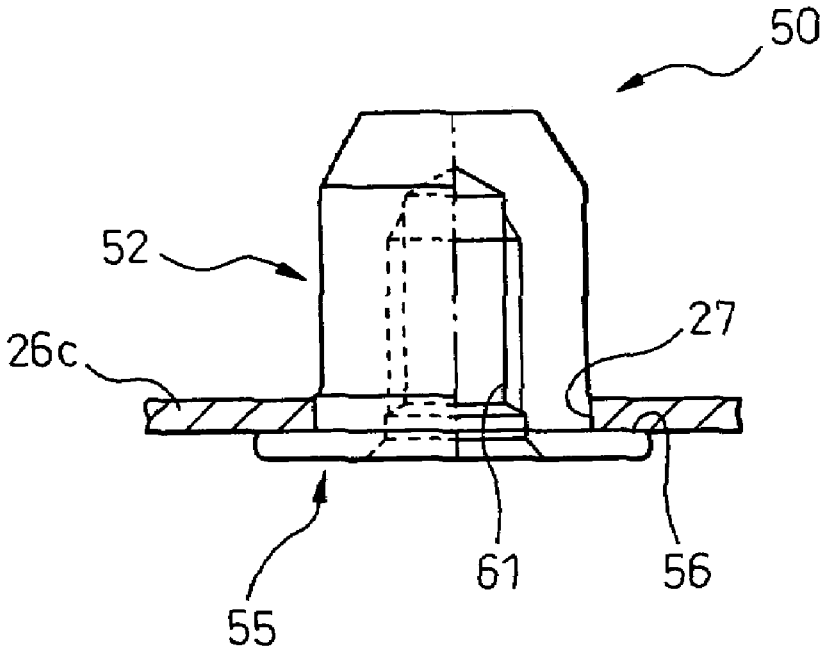
FIG. 4A is a front sectional view showing a nut of an embodiment of the present invention.
Figure 4B:
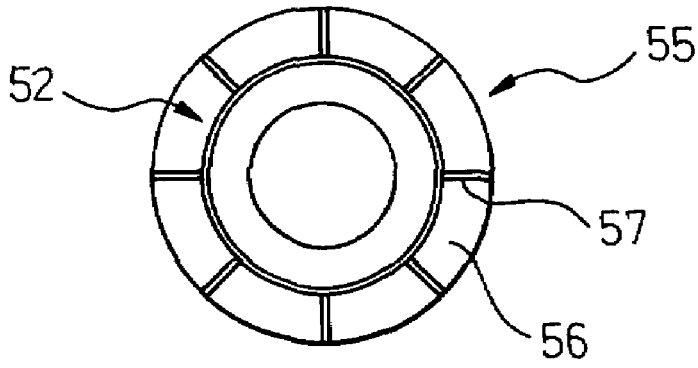
FIG. 4B is a plan view showing a nut of an embodiment of the present invention.
Figure 5:
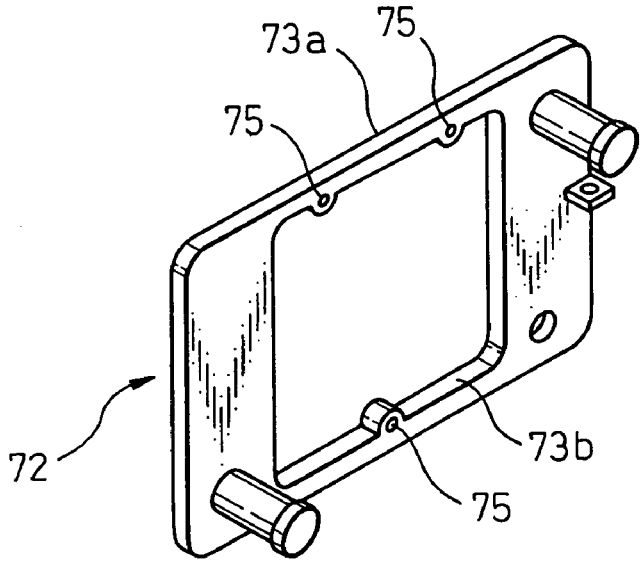
FIG. 5 is a perspective view showing a conventional example.
Figure 6:
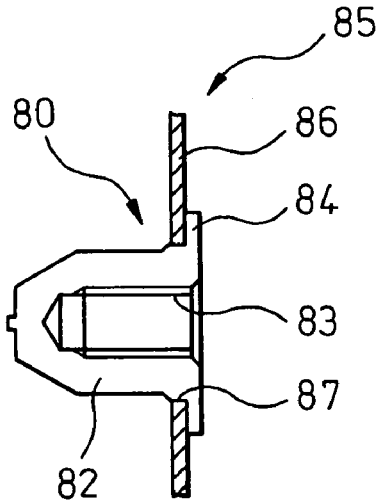
FIG. 6 is a front sectional view showing a primary portion of a comparative example.

Next, referring to FIGS. 4A and 4B, the nut 50 for mounting the electric fan, which will be referred to as a "nut" in the column of the embodiment, will be explained below. The nut 50 includes: a columnar main body portion 52 made of aluminum; and a flange portion 55 formed at one end in the axial direction. The main body portion 52 is circular in the lateral cross-section, and the outer diameter and length are predetermined. The outer diameter of the annular flange portion 55 is larger than the outer diameter of the main body portion 52, and the thickness of the annular flange portion 55 is predetermined. A plurality of guide grooves 57 (eight guide grooves 57 in this case) for guiding the brazing filler metal are radially formed on the end face of the flange portion 55. The width and depth of each guiding groove 57 for guiding the brazing filler metal are predetermined, and each guiding groove 57 for guiding the brazing filler metal linearly extends from the inner circumferential portion to the outer circumferential edge portion.

At the central portion of the flange portion 55 and the main body portion 52, the female screw portion 61, the inner diameter and depth of which are predetermined, is formed. One end of the female screw 61 extends to a portion close to the forward end portion of the main body portion 52, and the other end of the female screw 61 is open to the central portion of the flange portion 55. This nut 50 is manufactured by means of cold forging. At the time of manufacturing the nut 50, the guiding grooves 57 for guiding the brazing filler metal are simultaneously formed. The female screw hole 61 is formed in another step later.

The nut 50 is attached to the through-hole 27 of the wall portion 26*c* of the right tank member 25 while the nut 50 is penetrating the through-hole 27 so that the main body portion of the nut 50 can be protruded inside the right tank member 25. At this time, the nut 50 is attached so that the contact face 56 of the flange portion 55 can be contacted with an outer wall plane of the wall portion 26*c*.

Next, the action will be explained below. In the radiator, after the core 10, a pair of core plates 15, 17, a pair of tank members 20, 25 and a pair of mounting brackets 41, 46 have been temporarily assembled, these components are brazed to each other by heating. At the time of brazing, the brazing filler metal, which is clad and melted on the inner wall plane of the wall portion 26*c* of the right tank member 26, flows to the outer circumferential face of the root portion of the main body 52, the through-hole 27 of the wall portion 26*c* and the peripheries. The brazing filler metal is spread outward along the contact face 56 in the radial direction and the circumferential direction according to the contact of the flange portion 55 with the wall portion 26*c*. The brazing filler metal is spread out in the radial direction along the brazing filler metal guiding groove 57 radially formed on the contact face 56. In this way, the brazing filler metal is spread out between the flange portion 55 of the nut 50 and the wall portion 26*c* of the right tank 25. Therefore, the nut 50 is brazed to the right tank member 25 by the brazing filler metal.

Finally, the advantages will be explained below. According to this embodiment, the following advantages can be provided. The flange portion 55 of the nut 50 is tightly connected to the wall portion 26*c* of the right tank member 25 by the brazing filler metal. This is due to the formation of the radial brazing filler metal guiding groove 57 formed on the contact face 56 of the flange portion 55. That is, the brazing filler metal supplied to the through-hole 27 and its periphery flows outward in the radial direction in the brazing filler metal guiding groove 57 and spreads all over the flange portion 56. Due to the foregoing, the flange portion 56 and the wall portion 26*c* can be positively brazed to each other. As described above, by the formation of the brazing filler metal guiding groove 57, the brazing filler metal, which has been clad on the inner wall plane of the right tank member 25, can be spread out all over the flange portion 56. Accordingly, brazing can be positively conducted.

In the case where a sufficiently large quantity of the brazing filler metal has been supplied between the outer wall plane of the right tank member 25 and the contact face 56 of the flange portion 55 and brazing has been positively conducted, the brazing filler metal protrudes a little from the outer circumferential edge of the flange portion 55, and the brazed portion is formed in the outer circumferential edge of the flange portion 55. Therefore, especially when the brazing filler metal is not clad on the outer wall plane of the tank member 25 and the nut 50, according to the formation of the brazing filler metal portion at the outer circumferential edge of the flange portion 55, it is easy for a worker to visually ascertain the quality of the brazed portion.

In the embodiment of the invention, the nut 50 is brazed to the wall portion 26*c* which is parallel with the core 10 of the right tank member 25. This structure is convenient when the electric fan is attached in parallel with the core 10 in collaboration with the mounting portion 42 of the upper mounting bracket 41 and the mounting portion 47 of the lower mounting bracket 46. At the time of manufacturing the nut 50 by means of cold forging, the brazing filler metal guiding groove 57 can be simultaneously formed in the flange portion 55. Therefore, the manufacturing cost can be reduced.

In the embodiment described above, the tubes 12 of the core 10 are laminated in the vertical direction. However, the laminating direction of the tubes 12 is not limited to the above specific embodiment. In the embodiment described above, the brazing filler metal 57 is formed at the time of cold forging of the nut 50. However, the brazing filler metal 57 may be formed in another step after the nut has been manufactured.

While the invention has been described by reference to specific embodiments chosen for purposes of illustration, it should be apparent that numerous modifications could be made thereto by those skilled in the art without departing from the basic concept and scope of the invention.

The invention claimed is:

1. A heat exchanger comprising: a plurality of tubes in which a heat exchanging medium flows; tank members to which both end portions of these tubes are connected; and a female screw portion, into which a nut for attaching another member to the tank member is incorporated, brazed to the tank member, the female screw portion including:

a main body portion, at the center of which a female screw hole is formed, penetrating a wall portion of the tank member;

a flange portion, which is formed on one end side in the axial direction of the main body portion, contact with an outer plane of the wall portion; and a groove portion formed on a contact face of the flange portion in contact with the outer plane of the wall portion, wherein the flange portion is brazed to the wall portion; and the groove portion is radially formed.

2. A heat exchanger according to claim 1, wherein the brazing filler metal is clad on an inner wall face of the tank portion, and the brazing filler metal is not clad on an outer wall plane of the tank portion.

* * * * *